US006112045A

United States Patent [19]

Hauman

[11] Patent Number: 6,112,045

[45] Date of Patent: Aug. 29, 2000

[54] CONTAMINATION-FREE RELEASE AGENT MANAGEMENT (RAM) SYSTEM

[75] Inventor: Dewey H. Hauman, Penn Yan, N.Y.

[73] Assignee: Xerox Corporation, Stamford, Conn.

[21] Appl. No.: 09/410,715

[22] Filed: Oct. 4, 1999

[51] Int. Cl.[7] ..... G03L 15/20

[52] U.S. Cl. ..... 399/325

[58] Field of Search ..... 399/325, 326, 399/327, 328; 118/60; 432/60

[56] References Cited

U.S. PATENT DOCUMENTS

| | | | |
|---|---|---|---|
| 4,214,549 | 7/1980 | Moser | 118/60 |
| 5,500,722 | 3/1996 | Jacobs | 399/328 |
| 5,991,591 | 11/1999 | Chen et al. | 399/325 |

*Primary Examiner*—Joan Pendegrass

*Attorney, Agent, or Firm*—Tallam I. Nguti

[57] ABSTRACT

A heat and pressure fusing assembly including an ink contamination-free release agent management (RAM) system is provided for supplying and applying release agent material onto an outer surface of a heated fuser roller suitable for fusing toner filled-in areas of a preprinted form. The ink contamination-free RAM system includes a housing defining a sump containing release agent material, a donor roller mounted partially within the sump for contacting, and applying release agent material onto, a surface of a heated fuser roller, and a metering roller mounted within the sump for moving and transferring a layer of release agent material from the sump onto the donor roller. The metering roller has a low energy surface layer made of PerFluoroAlkoxy (PFA) for preventing ink contaminants reaching the donor roller from transferring onto the metering roller, thereby preventing poor application of release agent onto the metering roller, and image defects resulting from such poor application.

5 Claims, 1 Drawing Sheet

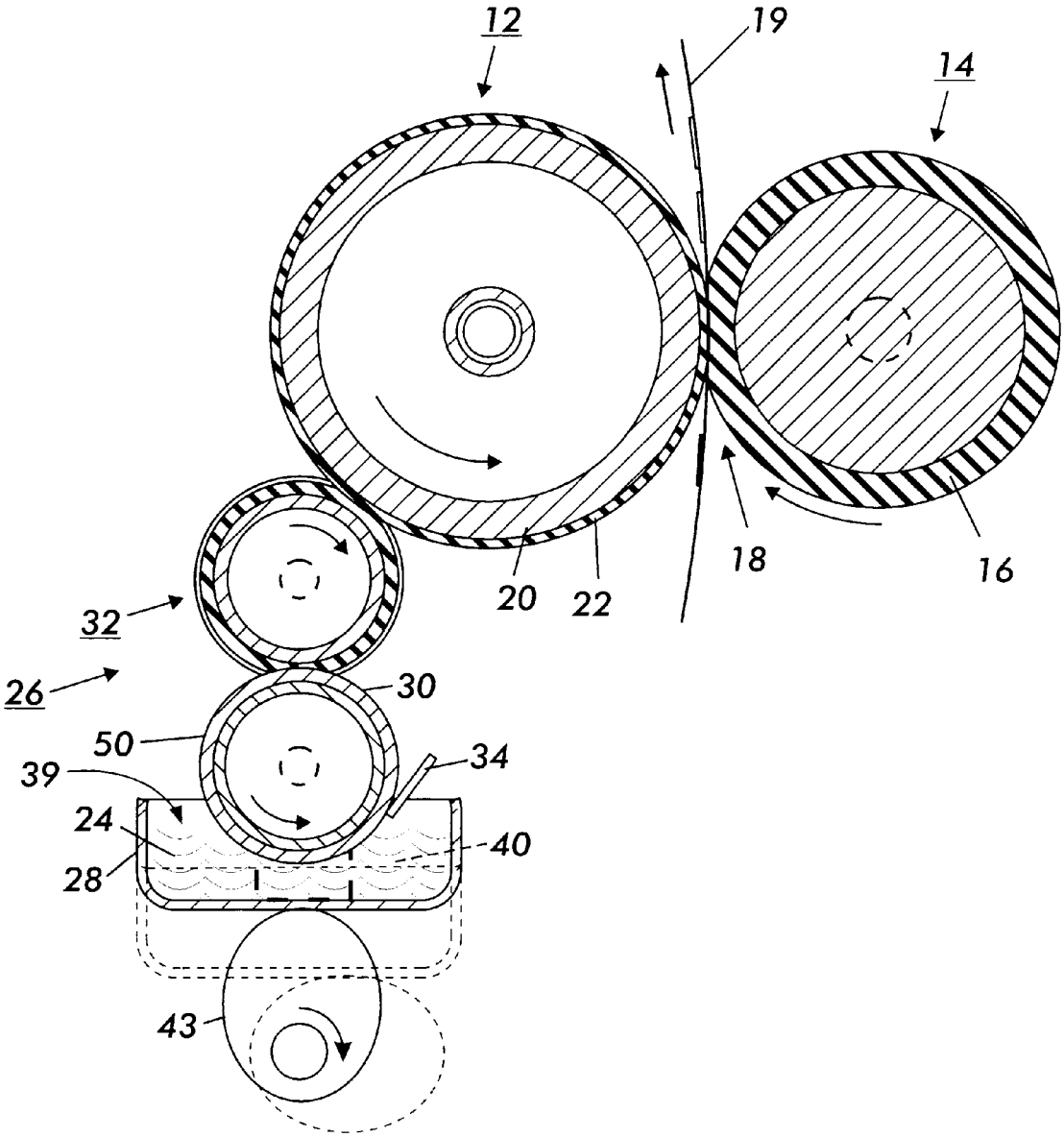
12
19
14
18
16
20
22
32
26
30
50
34
39
24
40
28
43

CONTAMINATION-FREE RELEASE AGENT MANAGEMENT (RAM) SYSTEM

BACKGROUND OF THE INVENTION

This invention relates generally to electrophotographic printing machines, and more particularly the invention is directed to a heated fuser roller and a pressure roller fusing assembly, in such a machine, including an ink contamination-free Release Agent Management (RAM) system having a low energy surface metering roller for effectively applying release agent to the heated fuser roller, thereby preventing toner image defects from release agent starvation for example.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roller or to a latent image on the photoconductive member. The toner attracted to a donor roller is then deposited on a latent electrostatic images on a charge retentive surface which is usually a photoreceptor. The toner powder image is then transferred from the photoconductive member to a copy substrate. The toner particles are heated to permanently affix the powder image to the copy substrate.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed rollers at least one of which is internally heated. During operation of a fusing system of this type, the support member to which the toner images are electrostatically adhered is moved through the nip formed between the rollers with the toner image contacting the heated fuser roller to thereby effect heating of the toner images within the nip.

In order to prevent the toner images from offsetting back onto the heated fuser roller, such a fusing system or assembly usually includes a release agent management (RAM) system for applying a release agent or oil onto the surface of the heated fuser roller.

It has been found that contamination of such a RAM system occurs as early as 3K prints or images have been fused when such prints or images are preprinted forms having preprinted areas and toner filled areas being fused. This problem is common with preprinted forms because hundreds of different inks are used in producing the preprinted areas, and often without dryers in the ink compositions. One reason is because such dryers are costly, and thus they are not used as often as is necessary. Additionally, some inks require over 72 hours to completely dry, thus preprinted forms may reach a toner fill-in and fuse operation before they are completely dry. Consequently, during fusing of the toner filled-in areas of such preprinted forms, ink that is not completely dry transfers from the preprinted form to the heated fuser roller, to a donor roller of the RAM system, and then to a conventional metering roller of the RAM system. Agravated by the inks not being completely dry, the adhesive forces of the ink to the rollers are believed to be higher than cohesive forces that should be holding the inks together.

Following is a discussion of some prior art, incorporated herein by reference, which may have some relevance to the question of patentability, and which, together with the detailed description to follow, may provide a better understanding and appreciation of the present invention.

U.S. Pat. No. 4,214,549 granted to Rabin Moser on Jul. 29, 1980 discloses a heat and pressure roller fusing assembly for fixing toner images to copy substrates, the toner comprising a thermoplastic resin. The assembly includes an internally heated, fuser roller cooperating with a backup or pressure roller to form a nip through which the copy substrates pass with the images contacting the heated roller. The heated fuser roller is characterized by an outer surface or surface which by way of example is fabricated from a silicon rubber or Vitont™ material to which a low viscosity polymeric release fluid is applied. Release fluid is contained in a sump from which it is dispensed by means of a metering roller and a donor roller, the former of which contacts the release fluid in the sump and the latter of which contacts the surface of the heated fuser roller.

U.S. Pat. No. 5,500,722 granted to Robert M. Jacobs on Mar. 19, 1996 relates to a Release Agent Management (RAM) system for a heat and pressure fusing assembly for fixing black toner images in low and high volume imaging machines and also for fixing color images. An auxiliary oil supply is provided for applying extra oil to an oil impregnated web. The extra oil improves fuser roller release life in every application. Also, enables color fusing which requires higher oil application rates.

BRIEF SUMMARY OF THE INVENTION

According to the intents and purposes of the present invention, a heat and pressure fusing assembly including an ink contamination-free release agent management (RAM) system is provided for supplying and applying release agent material onto an outer surface of a heated fuser roller suitable for fusing toner filled-in areas of a preprinted form. The ink contamination-free RAM system includes a housing defining a sump containing release agent material, a donor roller mounted partially within the sump for contacting, and applying release agent material onto, a surface of a heated fuser roller, and a metering roller mounted within the sump for moving and transferring a layer of release agent material from the sump onto the donor roller. The metering roller has a low energy surface layer made of PerFluoroAlkoxy (PFA) for preventing ink contaminants reaching the donor roller from transferring onto the metering roller, thereby preventing poor application of release agent onto the metering roller, and image defects resulting from such poor application.

DESCRIPTION OF THE DRAWING

The FIGURE is a schematic representation of a heat and pressure fusing assembly incorporating an ink contamination-free RAM system having a low energy surface metering roller in accordance with the present invention.

DETAILED DESCRIPTION OF THE INVENTION

While the present invention will be described in connection with a preferred embodiment thereof, it will be understood that it is not intended to limit the invention to this embodiments. On the contrary, it is intended to cover all alternatives, modifications, and equivalents as may be included within the spirit and scope of the invention as defined by the appended claims.

Disclosed in the FIGURE is a heat and pressure fusing assembly 10 useable in a toner image production machine for fusing toner filled-in areas of a preprinted form without image defects resulting from back and forth ink transfer from the preprinted form, and hence without contamination particularly of the preprinted areas of preprinted form.

As disclosed in the FIGURE, the fusing assembly 10 comprises a heated fuser roller 12 having an outer surface 13 suitable for contacting and fusing toner images, and a pressure roller 14 for forming a fusing nip 18 with the heated fuser roller 12. The heated fuser roller 12 comprises a rigid, thermally conductive core 20 supporting an outer elastomeric layer 22 which preferably ismade of Viton™, a fluoroelastomer material based on the copolymer of vinylidene fluoride and hexafluoropropylene. The pressure roller 14 includes a deformable layer 16 which under pressure applied by the fuser roller 12, deforms to form an elongated nip 18 through which a substrate 19 such as plain paper carrying toner images 21 passes during fusing.

The fusing assembly 10 includes an ink contamination-free release agent management (RAM) system 26 for supplying and applying release agent material 24 onto the outer surface 13 of the fuser roller 12. As illustrated, the ink contamination-free release agent management RAM system 26 includes a housing 28 defining a sump 39 containing the release agent material 24, and a donor roller 32 that as shown is mounted partially within the sump 39 for contacting, and applying the release agent material 24 onto the outer surface 13 of heated fuser roller 12.

The ink contamination-free release agent management RAM system 26 also includes a metering roller 30 that is mounted within the sump 39 for moving and transferring a layer of release agent material from the sump onto the donor roller 32. A metering blade 34 is mounted in a chiseling orientation into contact with the metering roller 30, for applying a layer of the release agent material 24 onto the surface of the metering roller 30. Importantly, in order to prevent contaminating or defect causing ink transfer from preprinted areas of filled-in preprinted forms being fused, the metering roller 30 includes a low energy surface, layer 50.

The image defects result when ink from the preprinted areas of the preprinted form is back-transferred first to the fuser roller 12, to the donor roller 32, and then to a conventional metering roller. Such back-transfer of ink is due to adhesive forces of the ink to the rollers (fuser, donor and conventional metering roller) being higher than cohesive forces of the ink to ink on the preprinted forms. The back-transferred ink contaminates the surface of a conventional metering roller, therefore causing undesirable variations in the layer of release agent or oil being applied by a metering blade for example 34 to the metering roller 30. The problem can often be severe enough to actually cause oil starvation resulting in jams and oil streaking, both of which are unacceptable.

In accordance with the present invention, the low energy surface layer 50 of the metering roller 30 is comprised of fluorinated polymer and copolymer material, preferably PerFluoroAlkoxy (PFA). The low energy surface layer 50 of PFA, for example, is approximately 0.002 inch thick, which acts to prevent back-transferring ink from transferring onto the metering roller 30.

Specifically as shown, the metering roller 30 of the present invention is partially immersed in the release agent material 24 and is supported for rotation such that it is contacted by the donor roller 32 which, in turn, is supported so as to be contacted by the heated roller 12. As can be seen, the orientation of the rollers 30 and 32 is such as to provide a path for conveying release agent material 24 from the sump 35 to the surface of the heated roller 12. As pointed out above, the metering roller 30 is preferably has a PFA surface layer 50, and has an outside diameter of about 1.0 inch.

As further shown, a wick blade 40 is fully immersed in the release agent and contacts the surface of the metering roller 30 to provide an air seal which disturbs the air layer formed at the surface of the roller 30 during rotation thereof. If it were not for the function of the wick or metering blade, the air layer would be coextensive with the surface of the roller immersed in the release agent thereby precluding contact between the metering roller and the release agent.

Additionally, a camming mechanism generally indicated by reference character 43 may serve to effect selective movement of the RAM system 26 such that the donor roller 32 contacts the fusing assembly outer surface 22 at the appropriate times and does not contact it during run mode.

As can be seen, there has been provided a heat and pressure fusing assembly including an ink contamination-free release agent management (RAM) system is provided for supplying and applying release agent material onto an outer surface of a heated fuser roller suitable for fusing toner filled-in areas of a preprinted form. The ink contamination-free RAM system includes a housing defining a sump containing release agent material, a donor roller mounted partially within the sump for contacting, and applying release agent material onto, a surface of a heated fuser roller, and a metering roller mounted within the sump for moving and transferring a layer of release agent material from the sump onto the donor roller. The metering roller has a low energy surface layer made of PerFluoroAlkoxy (PFA) for preventing ink contaminants reaching the donor roller from transferring onto the metering roller, thereby preventing poor application of release agent onto the metering roller, and image defects resulting from such poor application.

While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

What is claimed is:

1. An ink contamination-free release agent management (RAM) system for supplying and applying release agent material onto an outer surface of a heated fuser roller suitable for fusing toner filled-in areas of a preprinted form, the ink contamination-free RAM system including:

(i) a housing defining a sump containing release agent material;

(ii) a donor roller mounted partially within said sump for contacting, and applying release agent material onto, a surface of a heated fuser roller; and (iii) a metering roller mounted within said sump for moving and transferring a layer of release agent material from said sump onto said donor roller, said metering roller having a low energy surface layer for preventing transfer of ink contaminants from said donor roller onto said metering roller, thereby preventing poor application of release agent on said metering roller and image defects resulting from such poor application.

2. The ink contamination-free RAM system of claim 1, wherein said low energy surface layer of said metering roller is made of PerFluoroAlkoxy (PFA).

3. A heat and pressure fusing assembly suitable for use in a toner image production machine to fuse filled-in areas of a preprinted form without contaminating preprinted areas thereof, said fusing assembly comprising:

(a) a heated fuser roller having an outer surface suitable for contacting and fusing toner images;

(b) a pressure roller for forming a fusing nip with said heated fuser roller; and (c) an ink contamination-free release agent management (RAM) system for supplying and applying release agent material onto said outer surface of said fuser roller, said RAM system including:

(i) a housing defining a sump containing release agent material;

(ii) a donor roller mounted partially within said sump for contacting, and applying release agent material onto, a surface of a heated fuser roller; and (iii) a metering roller mounted within said sump for moving and transferring a layer of release agent material from said sump onto said donor roller, said metering roller having a low energy surface layer for preventing transfer of contaminants from said sump onto said donor roller, thereby preventing transfer of such contaminants onto the fuser roller and preprinted areas of a filled-in preprinted form being fused in a toner image production machine.

4. The heat and pressure fusing assembly of claim 3, wherein said low energy surface layer of said metering roller is made of PerFluoroAlkoxy (PFA).

5. An electrostatographic reproduction machine comprising:

(a) a movable image bearing member having a toner image carrying surface defining a path of movement therefor;

(b) electrostatographic devices mounted along said path of movement for forming a toner image on said toner image carrying surface;

(c) means for transferring said toner image from said toner image carrying surface onto a substrate;

(d) a heat and pressure fusing assembly including a heated fuser roller and a pressure roller forming a fusing nip with said fuser roller; and (e) an ink contamination-free release agent management (RAM) system for supplying and applying release agent material onto an outer surface of said heated fuser roller, the RAM system including:

(i) a housing defining a sump containing release agent material;

(ii) a donor roller mounted partially within said sump for contacting, and applying release agent material onto, a surface of a heated fuser roller; and (iii) a metering roller mounted within said sump for moving and transferring a layer of release agent material from said sump onto said donor roller, said metering roller having a low energy surface layer for preventing transfer of contaminants from said sump onto said donor roller, thereby preventing transfer of such contaminants onto the fuser roller and preprinted areas of a filled-in preprinted form being fused in a toner image production machine.

* * * * *